US008109276B2

(12) United States Patent
Gidding

(10) Patent No.: US 8,109,276 B2
(45) Date of Patent: Feb. 7, 2012

(54) DEVICE, ASSEMBLY AND METHOD FOR FILTERING TOBACCO SMOKE FROM A CIGARETTE

(75) Inventor: Marinus Theodorus Franciscus Maria Gidding, Elst (NL)

(73) Assignee: Vituva Operations Limited, Nicosia (CY)

( * ) Notice: Subject to any disclaimer, the term of this patent is extended or adjusted under 35 U.S.C. 154(b) by 627 days.

(21) Appl. No.: 12/160,160

(22) PCT Filed: Jan. 5, 2007

(86) PCT No.: PCT/NL2007/000005

§ 371 (c)(1),
(2), (4) Date: Jul. 7, 2008

(87) PCT Pub. No.: WO2007/078197

PCT Pub. Date: Jul. 12, 2007

(65) Prior Publication Data

US 2009/0007926 A1 Jan. 8, 2009

(30) Foreign Application Priority Data

Jan. 6, 2006 (NL) ..... 1030850
Feb. 2, 2006 (NL) ..... 1031051

(51) Int. Cl.
*A24D 1/04* (2006.01)
*A24B 15/00* (2006.01)

(52) U.S. Cl. ..... 131/202; 131/201; 131/207; 131/331; 131/175; 131/187

(58) Field of Classification Search ..... 131/202, 131/175, 187, 329, 331, 201, 207
See application file for complete search history.

(56) References Cited

U.S. PATENT DOCUMENTS

| | | | | |
|---|---|---|---|---|
| 5,160,518 | A | 11/1992 | Vega, Jr. | |
| 5,495,859 | A * | 3/1996 | Bowen et al. | 131/202 |
| 5,678,576 | A * | 10/1997 | Nazaroff et al. | 131/331 |
| 6,006,757 | A * | 12/1999 | Lichtenberg | 131/187 |
| 2004/0173230 | A1 * | 9/2004 | Snaidr et al. | 131/360 |

FOREIGN PATENT DOCUMENTS

| | | | |
|---|---|---|---|
| CA | 2252198 | A1 | 5/2000 |
| DE | 10012229 | A1 | 7/2001 |
| WO | 9423600 | A1 | 10/1994 |
| WO | 9502970 | A1 | 2/1995 |
| WO | 9741744 | A1 | 11/1997 |
| WO | 0167899 | A1 | 9/2001 |
| WO | 2005055748 | A2 | 6/2005 |

* cited by examiner

*Primary Examiner* — Richard Crispino
*Assistant Examiner* — Dionne Walls Mayes
(74) *Attorney, Agent, or Firm* — The Webb Law Firm

(57) ABSTRACT

The invention relates to a device for filtering tobacco smoke from a cigarette, in particular a filter cigarette, the device comprising a portable housing provided with a combustion space in which the cigarette can burn, a filter unit for filtering the tobacco smoke of a burning cigarette, at least one discharge opening for discharging filtered tobacco smoke and one or more tobacco smoke displacing units for displacing the tobacco smoke via the filter unit to the discharge opening, wherein a mouthpiece is formed on the housing, the mouthpiece comprising a holding unit for holding the cigarette, wherein the holding unit comprises an opening along which the cigarette can be pushed partially into the housing from outside the housing, and the opening is formed to hold the cigarette clampingly in the partially inserted situation.

22 Claims, 6 Drawing Sheets

DEVICE, ASSEMBLY AND METHOD FOR FILTERING TOBACCO SMOKE FROM A CIGARETTE

The present invention relates to a device and method for filtering tobacco smoke from a cigarette. The invention also relates to an external power source for lighting a filter cigarette in such a device and to the assembly of the device and external power source.

Portable devices are known with which the smoke gases caused by cigarette are filtered before they enter the environment. These devices are applied for instance in spaces such as cafes, restaurants, airports, working areas and the like in which smoking is forbidden or undesirable because the smoke gases are damaging to the health of the people in the space. The smoker places a cigarette wholly into a tobacco reservoir of the device, the cigarette is lit and the smoke gases from the cigarette are carried by means of one or more fans along a filter provided in the device. The filter removes harmful substances from the smoke gases in order to prevent these substances entering the environment. Some of the known devices filter not only the smoke gases coming directly from the cigarette but also the smoke gases inhaled by the smoker and subsequently exhaled. This means that the greater part of the smoke gases is filtered. The people in said space are hereby no longer inconvenienced by the fact that the smoker is smoking in the space.

An example of such a smoke gas filtering device is shown in the international patent application WO 2005/055748 A2. The known smoke gas filtering device does however have a number of drawbacks.

In the known device smoke gases are drawn in via a fan arranged in the housing of the device and then driven through a carbon filter in order to remove harmful substances from the smoke gases before they are discharged to the environment via one or more openings in the housing. It has been found that by providing the fan on the upstream side of the filter a sufficiently large delivery pressure can be brought about for a good discharge of the smoke gases, while it is still possible to suffice with a relatively small fan. The known smoke gas filter device has the drawback however that in the course of time the smoke gases adversely affect the operation of the fan. The smoke gases pass through the fan in unfiltered state, wherein the unfiltered smoke gases comprise constituents which strongly contaminate the fan, in particular the impeller or blades, the drive motor and/or the control circuits such that the operation thereof greatly deteriorates. The lifespan of the fan is also shortened.

Another drawback of the known smoke gas filter device is that it is quite complex, and this increases the cost price. Due to the complexity and the presence of numerous valves in the device the pressure drop thereover is often quite large, which makes heavy demands of the fans with which the smoke gases are drawn off and/or of the power supply of the electrical components in the device.

A further drawback is that smoking using a known device is so different from normal smoking of a cigarette that in practice the smoker must overcome a great deal of reluctance to begin smoking with the device.

It is an object of the present invention to provide an improved method and device.

According to a first aspect of the present invention, there is provided for this purpose a device for filtering tobacco smoke wherein the device comprises a portable housing provided with a combustion space in which the cigarette can burn, a filter unit for filtering the tobacco smoke of a burning cigarette, at least one discharge opening for discharging filtered tobacco smoke and one or more tobacco smoke displacing units for displacing the tobacco smoke via the filter unit to the discharge opening, wherein a mouthpiece is formed on the housing, the mouthpiece comprising a holding unit for holding the cigarette, wherein the holding unit comprises an opening along which the cigarette can be pushed partially into the housing from outside the housing, and the opening is formed to hold the cigarette clampingly in the partially inserted situation. The tipped or untipped cigarette can therefore be easily pushed into the device without additional operations having to be performed here, such as for instance opening and closing a flap or gaining access to a tobacco reservoir. Because the cigarette is so simple to arrange, there is as little as possible standing in the way of the smoker using the device. Furthermore, because the filter of the cigarette remains protruding wholly or partially outside the housing in the inserted situation, the smoker can place his/her lips on the filter of the cigarette itself and smoke the cigarette normally as he/she is accustomed to do. Owing to the direct contact of the lips of the smoker with the cigarette itself the normal manner of smoking is imitated as closely as possible.

The inventor has come to see that since the filter of the cigarette does not allow passage of smoke as long as the smoker is not drawing on the cigarette, the filter does not have to be arranged inside the housing in order to discharge possible smoke gases. This means that the cigarette can protrude with its filter part outside the housing without the danger of smoke gases exiting to the outside in undesirable manner via the filter. The inventor has also come to see that the suction action of the tobacco smoke displacing units, which units bring about underpressure in the combustion space, is sufficient here to draw off the tobacco smoke accumulating in the combustion space without the tobacco smoke exiting to the outside via the mouthpiece. Said suction action is sufficient even when an untipped cigarette is used. A further advantage is that when the cigarette is finished, the smoker can readily pull the cigarette, or at least what is left of it, out of the device via the outer end of the filter or can press the cigarette further into the combustion space in order to enable insertion of a subsequent cigarette in the holding unit. In the latter case not only the ash but also the remainder of the smoked cigarette comes to lie the combustion space. The smoker does not in that case no longer has to immediately dispose of the remainder of the cigarette him/herself.

According to a first preferred embodiment, the opening of the holding unit is formed to hold the filter of a tipped cigarette clampingly and to allow passage of the remaining part of the cigarette. The filter part is often slightly thicker, or at least provides more elastic resistance to compression. Use is made in the embodiment of this property of a tipped cigarette. The first part of the cigarette can be pushed without great difficulty through the holding unit while, having arrived at the filter, the holding unit can clamp the cigarette fixedly to the correct extent.

According to a further preferred embodiment, a stop element is arranged in the combustion space for limiting the length along which the cigarette can be pushed into the housing. This prevents the smoker pushing the cigarette too far into the combustion space.

According to a third embodiment, the stop element is positioned in the housing such that the outer end of the cigarette extends wholly or partially outside the housing in the partially inserted situation. In the case of a tipped cigarette the filter part of the cigarette automatically protrudes from the housing of the device over the desired distance.

According to a further preferred embodiment, the distance between the stop element and the outer side of the mouthpiece amounts to between 6 cm and 8 cm, preferably about 7 cm. This distance is suitable for cigarettes of standard size. For longer cigarettes, also referred to as king-size cigarettes, said distance is chosen correspondingly larger.

According to a further preferred embodiment, the holding unit comprises a holding element with a substantially circular cross-section, the diameter of which corresponds substantially to the diameter of a cigarette. The holding element is in this embodiment a cylinder or ring into which the cigarette can be inserted.

According to a further preferred embodiment, the device comprises an extinguishing ring which can be placed round the cigarette for the purpose of extinguishing the cigarette at a predetermined position, so that the cigarette always goes out at a predetermined position and the cigarette is prevented from burning too far, for instance as far as the filter of the cigarette.

According to a further preferred embodiment, the holding unit is provided with connecting means for connecting a tubular element slidable over the free outer end of the cigarette, in particular over the filter. For smokers who wish to do so, it is hereby possible to nevertheless draw on a tubular element instead of directly on the filter of the cigarette.

According to a further preferred embodiment, said mouthpiece of the device is provided with one or more openings connected to the combustion space for feeding fresh air and discharging tobacco smoke exhaled by the smoker. Said openings not only have the function of feeding fresh air to allow combustion of the cigarette, but also of discharging air exhaled by the smoker. The openings are preferably positioned around the holding unit, and still more preferably on either side of the holding unit, so that the smoker can allow his/her lips to rest over the filter on the edges of the mouthpiece while exhaling the smoke gases, and can imitate as closely as possible the usual smoking action. A compact device is moreover provided by providing the locations of inhaling the tobacco smoke and exhaling the tobacco smoke in the vicinity of each other.

According to a further preferred embodiment, a filter space in which a filter unit is arranged is provided adjacently of the combustion space in the housing, wherein the filter unit comprises:

- a HEPA (high-efficiency particulate air) filter arranged in the form of a cone and positioned between the combustion space and discharge opening;
- an active carbon filter positioned between the HEPA filter and the discharge opening.

According to a further preferred embodiment, the filters are arranged in a filter bag, wherein the filter bag is provided with attaching means which are adapted to attach the filter bag removably in the housing. The filter unit can hereby be easily replaced.

According to a further preferred embodiment, the HEPA filter takes a pleated form so that the effective filter surface area is further enlarged, this enhancing the filtering action.

According to a further preferred embodiment, the filter unit comprises an electrostatically charged HEPA filter.

According to a further preferred embodiment, the filter device comprises:

- electrical igniting means for lighting the cigarette,
- terminals which are coupled to the electrical igniting means and which are accessible from outside the housing for the purpose of powering the igniting means with an external electrical power source, in particular a battery, present outside the housing. By keeping the power source for lighting the cigarette outside the device the device remains of simple and light construction. The power source is here for instance a standard battery which the smoker keeps in his/her pockets, just as the smoker normally keeps a gas lighter in his/her pockets.

According to a further preferred embodiment, electrical terminals are provided in the housing wall of the device, and these are adapted to be able to make contact with corresponding terminals of the electrical power source, in particular with the battery terminals.

According to a further preferred embodiment, the igniting means are arranged close to the stop element, and with particular preference they are mounted on the stop element. In this latter case the stop element can ensure that the igniting means are less likely to be damaged, for instance when the cigarette is inserted into the device.

According to a further preferred embodiment, the stop element is formed by the igniting means. In this embodiment the igniting means themselves take a robust form such that they can function as stop element for the cigarette.

According to a further preferred embodiment, the holding unit comprises a passive extinguishing element for extinguishing the cigarette when the cigarette has burned over a predetermined distance. A simple means is hereby provided which prevents the cigarette burning down too far. In the case of a filter cigarette this can for instance prevent the filter beginning to burn, which would produce an unpleasant taste for the smoker. In an advantageous embodiment the passive extinguishing element is therefore embodied as an extinguishing element in practically or wholly annular form positioned round the cigarette close to the filter, also referred to as an extinguishing ring.

According to another preferred embodiment, the device comprises a visual indicator which is adapted to indicate that the cigarette has burned away to a predetermined extent. Because the cigarette is arranged in the device, the smoker cannot see, or at least see less well, when his/her cigarette is finished. The device can therefore be provided with a visual indicator which informs the smoker of the extent to which the cigarette has already burned away.

According to a particularly advantageous embodiment, the device comprises one or more heat-conducting elements extending from the outside of the housing into the combustion space, each provided with thermo-optical material for generating a colour representative of the temperature in the combustion space.

In order to be ensured of a good discharge of smoke gases, there is provided according to a further aspect of the invention a device for filtering tobacco smoke from a tobacco product, in particular a cigarette, the device comprising a portable housing, provided with a combustion space in which the cigarette can burn, a filter unit for filtering the tobacco smoke of a burning cigarette, at least one discharge opening for discharging filtered tobacco smoke and at least one tobacco smoke displacing unit for displacing the tobacco smoke to the discharge opening, wherein the filter unit comprises at least one first filter component for pre-filtering the tobacco smoke and a second filter component positioned downstream thereof for further filtering of the tobacco smoke, and wherein the tobacco smoke displacing unit is disposed between the first and second filter component. Because the tobacco smoke reaching the displacing unit has already undergone a first filtering, the adverse effect on the displacing unit can be greatly reduced, certainly when the first filter component comprises a filter of the HEPA type. This type of filter filters particularly those substances which have been found to be damaging to the displacing unit. The pressure drop over the first filter component is moreover limited, which enhances a good throughflow of the tobacco smoke through the filter unit. Due to the positioning of the displacing unit between the two filters the displacing unit can moreover press the pre-filtered tobacco smoke in relatively simple manner through the following filter component, which preferably comprises a filter of active carbon, and this further improves the through-flow.

In a determined preferred embodiment a tipped or untipped cigarette can be readily inserted into the device without additional operations having to be performed, such as for instance opening and closing a flap or gaining access to a tobacco reservoir. Because the cigarette is so simple to arrange, there is as little as possible standing in the way of the smoker using the device. Furthermore, because the filter of the cigarette remains protruding wholly or partially outside the housing in the inserted situation, the smoker can place his/her lips on the filter of the cigarette itself and smoke the cigarette normally as he/she is accustomed to do. Owing to the direct contact of the lips of the smoker with the cigarette itself the normal manner of smoking is imitated as closely as possible.

According to a further preferred embodiment, the HEPA filter takes a pleated form, so that the effective filter surface area is further enlarged, this enhancing the filtering action. According to a further preferred embodiment, the filter unit comprises an electrostatically charged HEPA filter.

According to yet another aspect of the invention, a method is provided for filtering tobacco smoke from a cigarette, in particular a filter cigarette, with a device comprising a portable housing provided with a combustion space in which the cigarette can burn, at least one first filter component for pre-filtering the tobacco smoke from the cigarette, at least one second filter component positioned downstream thereof for further filtering of the tobacco smoke, at least one discharge opening for discharging tobacco smoke and at least one tobacco smoke displacing unit for displacing the tobacco smoke to the discharge opening, the method comprising the steps of:

- drawing tobacco smoke from the combustion chamber with the tobacco smoke displacing unit and guiding the tobacco smoke through the first filter component for pre-filtering thereof;
- pressing tobacco smoke through the second filter component with the tobacco smoke displacing unit for further filtering thereof;
- discharging filtered tobacco smoke to the environment via the discharge opening.

According to yet another aspect of the present invention, an external power source is provided which is provided with power source terminals which are adapted to be able to make conductive contact with corresponding terminals of the filter device according to any of the foregoing claims described herein. The external power source preferably comprises a holder which is provided with power source terminals and in which a battery can be accommodated, in addition to connecting elements for providing an electrical connection between the battery terminals and power source terminals.

According to a further preferred embodiment, the power source terminals are recessed into the holder wall, so reducing the chance of the terminals making contact in undesired manner, thus causing the battery to run down.

According to a further aspect of the present invention, there is provided an assembly of the device described herein and one or more of the external power sources described herein. The power sources can here be specifically adapted to be able to make contact in unique manner with the terminals of the device, thereby ensuring the use of an appropriate power source for the device.

According to a further aspect of the invention, a method is provided for filtering tobacco smoke from a filter cigarette, wherein the method comprises of:

- pushing a cigarette so far through the holding unit of the mouthpiece that the filter of the cigarette remains wholly or partially outside the housing and the rest of the cigarette extends in the combustion space;
- clamping the cigarette in the holding unit;
- lighting the cigarette;
- drawing the tobacco smoke out of the combustion space.

The method preferably also comprises of first guiding the tobacco smoke through a conical HEPA filter and subsequently guiding the tobacco smoke through a filter of active carbon.

Further advantages, features and details of the present invention will be elucidated on the basis of the following description of a preferred embodiment thereof. Reference is made in the description to the accompanying figures, in which.

Figure 1:
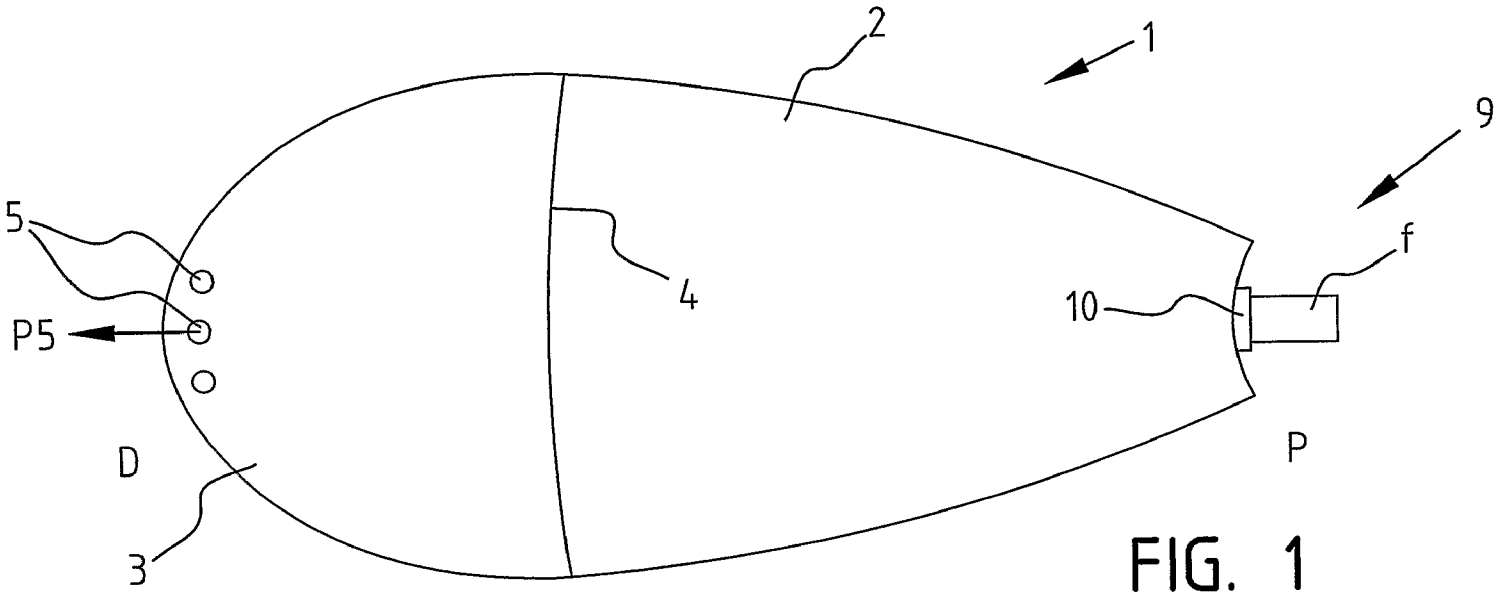
FIG. 1 shows a top view of a preferred embodiment of a smoking unit according to the invention.
Figure 2:
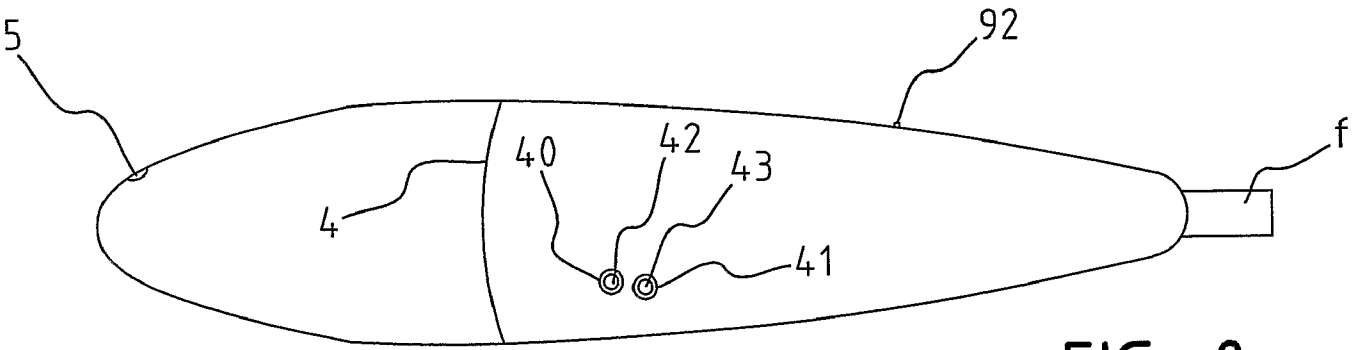
FIG. 2 shows a side view of the preferred embodiment of the smoking unit.

FIGS. 1 and 2 show the plastic housing 1 of a smoking unit according to a preferred embodiment of the invention. This is constructed from a proximal housing part 2 and a distal housing part 3. Both housing parts can be separated from each other at the position of seam 4 so that the interior of housing 1 can be accessed. A mouthpiece 9 is provided at the proximal outer end of housing 1, while a number of tobacco smoke discharge openings 5 are arranged on the distal outer end of the housing.

Figure 3:
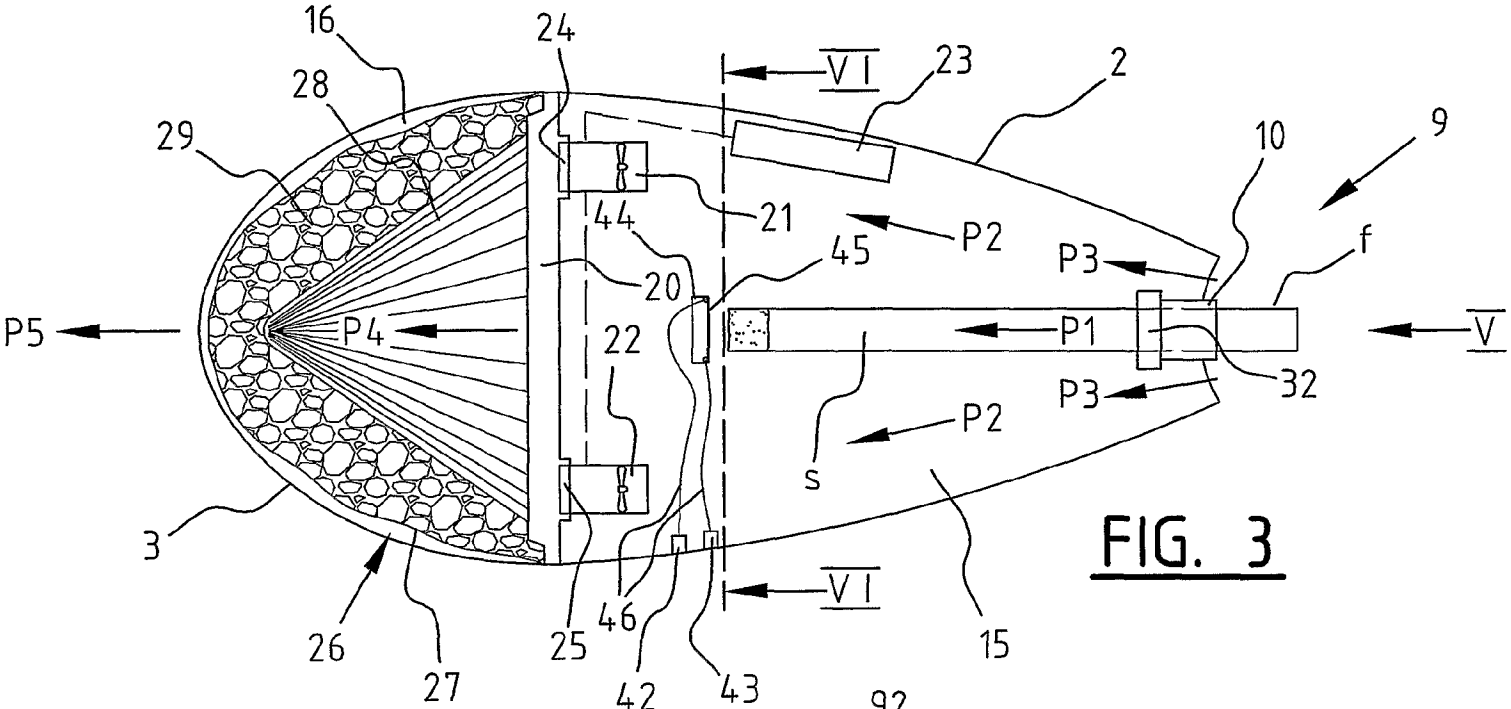
FIG. 3 shows a partly cut-away top view of the preferred embodiment of the smoking unit.
Figure 4:
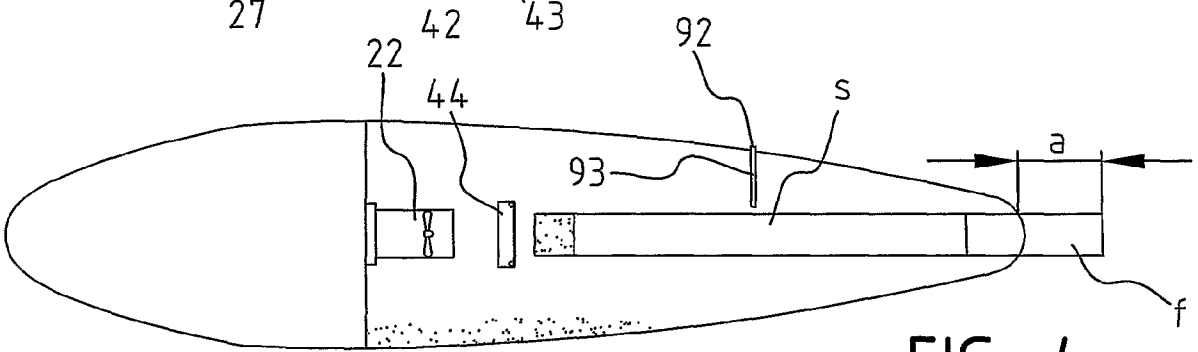
FIG. 4 shows a partly cut-away side view of the preferred embodiment of the smoking unit.

FIGS. 3 and 4 show schematically the internal parts of the smoking unit. The smoking unit comprises in the proximal housing part 2 a single space, also referred to as combustion space 15, while in distal part 3 there is formed a single space which is also referred to as the filter space 16. A cigarette S can be pushed from right to left (direction $P_1$) into combustion space 15. For this purpose the cigarette can be placed with it distal end into a holding ring 10 of mouthpiece 9 and pushed further until the proximal part of the cigarette, or filter F, reaches the holding ring. The diameter d (compare FIG. 5) of holding ring 10 corresponds here to the diameter of cigarette. The diameter d of holding ring 10 is more particularly chosen such that the part of cigarette for smoking can be pushed along the ring more easily than the filter F. This means that cigarette can be pushed inward relatively easily (direction $P_1$) and can be clamped fixedly at the position of the filter.

In order to ensure that the smoker does not press cigarette too far inward and that the whole of the cigarette would end up in combustion space 15, a stop element 44 is provided (FIG. 3, FIG. 4). The distance between stop element 44 and the proximal end of mouthpiece 9 is chosen such that it roughly corresponds to the length of the cigarette without the filter. During insertion the smoker therefore presses cigarette so far in that it comes to lie against stop element 44. Filter F of the cigarette herein always remains protruding wholly or partially outside the housing, so that the smoker can place his/her lips round filter F in the usual manner in order to smoke the cigarette.

Figure 6:
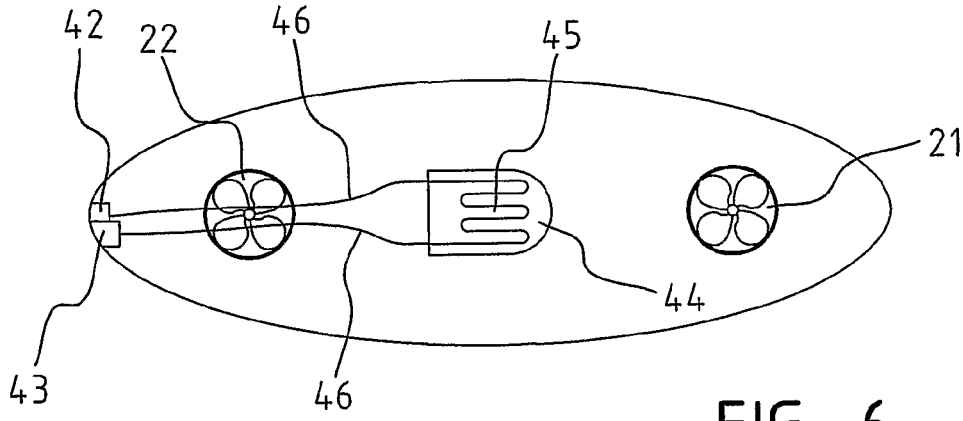
FIG. 6 shows a schematic cross-section through the preferred embodiment of the smoking unit.

In order to light the cigarette use is made of an electrical ignition. The ignition is shown in FIGS. 3 and 4 and in more detail in FIG. 6. The ignition comprises one or more filaments 45 arranged in spiral manner close to the outer end of the cigarette. In the shown embodiment the filaments 45 are mounted against the surface of stop element 44. Filaments 45 are connected using electrical wires 46 to respective electrical contacts or terminals 42, 43 provided in respective recesses 40, 41 of housing part 2. An electrical current is generated in wires 46 by providing terminals 42, 43 with the correct voltage, whereby filaments 45 will become red hot and light the outer end of the cigarette.

The power source for lighting a cigarette is arranged outside housing 2 in order to keep the construction of the smoking unit as simple as possible and limit the weight. In a determined embodiment terminals 42, 43 are adapted to be able to make contact with corresponding terminals of a standard battery, for instance a 9 V or 12 V battery of the block type. By holding the battery briefly against contacts 42, 43 sufficient electric current is generated in filaments 45 to cause lighting of the cigarette. Once the cigarette is lit, the battery can be stowed away again, for instance in the trouser pocket of the smoker.

Figure 9:
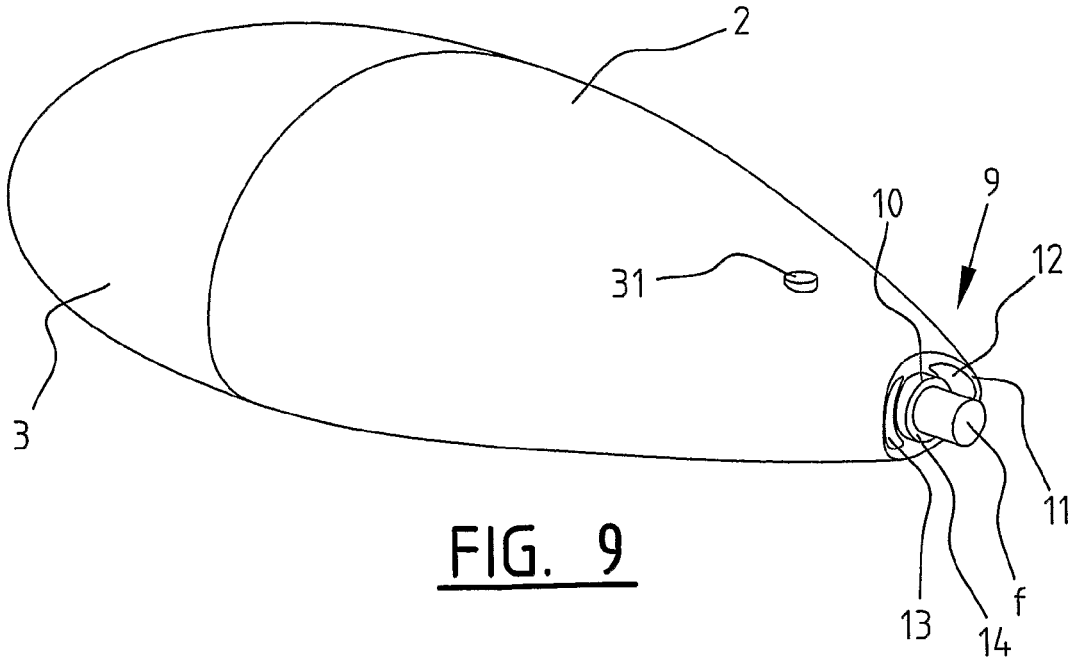
FIG. 9 shows a perspective view of a further preferred embodiment of the smoking unit.

In another embodiment a battery available per se as standard product is arranged in a special holder. This holder preferably has a form similar to the form of the smoking unit itself, i.e. the elongate droplet form as shown in FIG. 9. The holder is provided with a closing flap which can be opened to expose the terminals of the battery. Once the cigarette has been lit, the flap can be closed so that the terminals of the battery are screened from the outside world and the battery is for instance prevented from running down.

Figure 7:
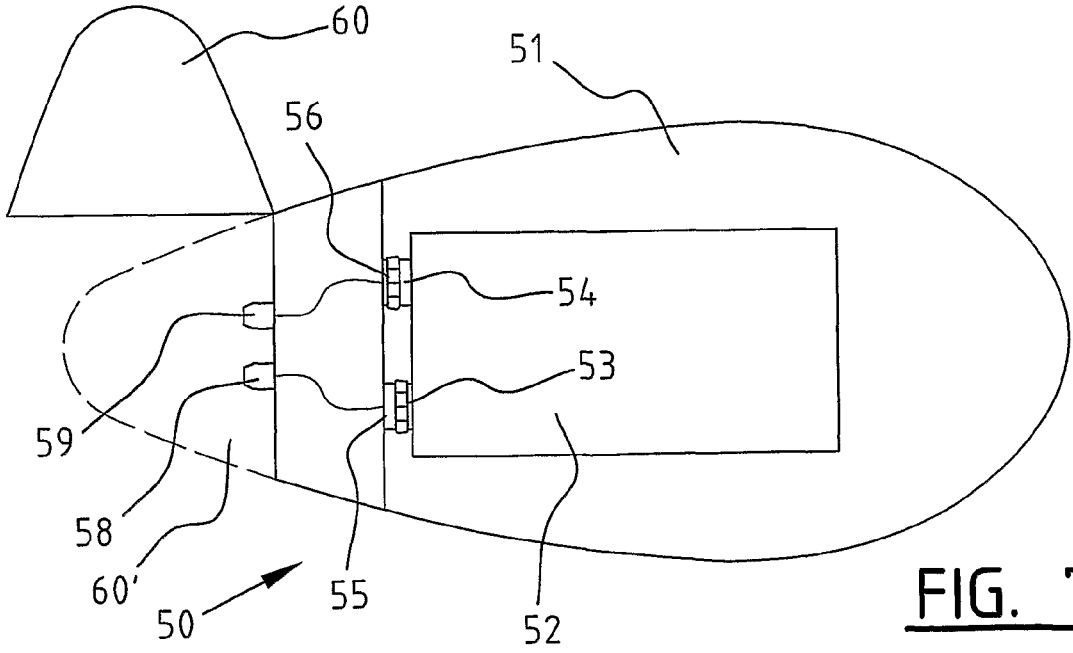
FIG. 7 is a partly cut-away schematic view of a preferred embodiment of an external power source according to the invention.

In a further preferred embodiment as shown in FIG. 7, the battery 52 of the block type obtainable per se as standard product is arranged in a holder 51, this holder being provided with adapter elements 55, 56 which can be connected to terminals 53, 54 of battery 52. Adapter elements 55, 56 are in turn coupled to respective power source terminals 58 and 59. Power source terminals 58, 59 can be closed off in the above described manner via a closing flap 60 ($P_6$, FIG. 7). In the shown embodiment the power source terminals 58, 59 are of the same form so that the power source can be connected in two positions to terminals 42, 43 of the smoking unit. The polarity is in any case not important in the generating of current to cause heating of filaments 45. An advantage hereof is that the smoker no longer has to concern him/herself with the polarity, which enhances convenience of use. A further advantage is that by arranging correct adapter elements 55, 56 in holder 51 the external power source 50 can be made suitable for different types of standard batteries 52.

Lighting of the cigarette by placing the external power source onto terminals 42, 43 also ensures that two fans 21, 22 are switched on. An optional setting is that the fans continue to rotate for a predetermined fixed time, for instance a few minutes (a cigarette does after all burn away within a few minutes irrespective of the degree to which the smoker has inhaled). Fans 20, 21 are coupled to an internal battery 23 and ensure that the tobacco smoke accumulating in the combustion space can be discharged ($P_2$-$P_4$) in the direction of filter space 16 via discharge openings 24, 25 in a partition wall 20 connecting to combustion space 15.

A filter 26 is arranged in filter space 16. In the shown embodiment this filter comprises a bag 27 arranged on the end edges of the distal part 3 of housing 1. In the bag are arranged a first filter for pre-filtering the supplied tobacco smoke and a second filter (and optional further filters) for further treatment of the tobacco smoke. The first filter 28 preferably consists of an electrostatically charged HEPA filter. Once the tobacco smoke has been filtered by HEPA filter 28, it returns to the space behind HEPA filter 28 in which active carbon is arranged. This active carbon filter 29 provides for further filtering of the tobacco smoke.

Figure 8:
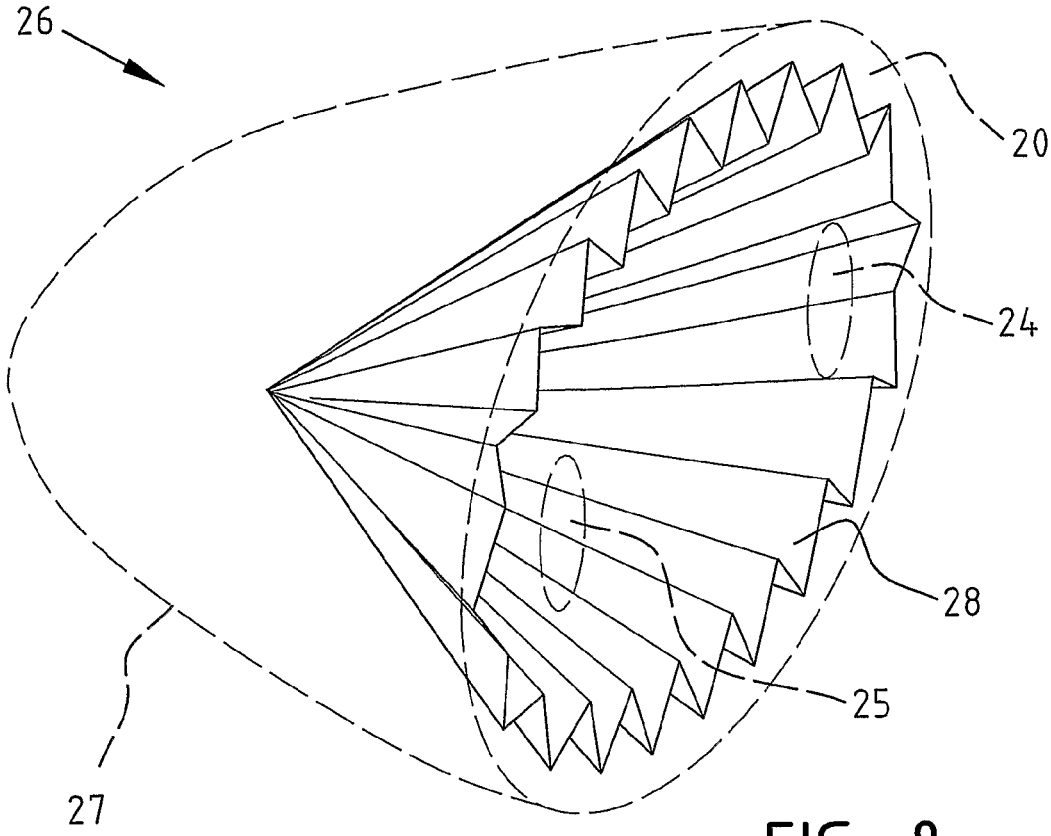
FIG. 8 is a partly cut-away view in perspective of a preferred embodiment of the HEPA filter.

In the embodiment shown in FIG. 3 and in more detail in FIG. 8, the HEPA filter is constructed from an elongate strip which is first pleated and then arranged into a conical form (by pressing together one outer end and allowing the other outer end to fan out). The conical HEPA filter is positioned with the wide side in the direction of the supplied smoke gases so that a maximal filter surface area (at least 80 $cm^2$) is made available. With this embodiment of the HEPA filter a very large filter surface area can be achieved in relation to the space occupied by the filter.

The HEPA filter is preferably statically charged, although this is not essential in all embodiments.

Once the tobacco smoke has passed through HEPA filter 28 and active carbon filter 29 ($P_4$), it is discharged ($P_5$, FIG. 3) via discharge openings 5 in housing part 3.

Figure 5:
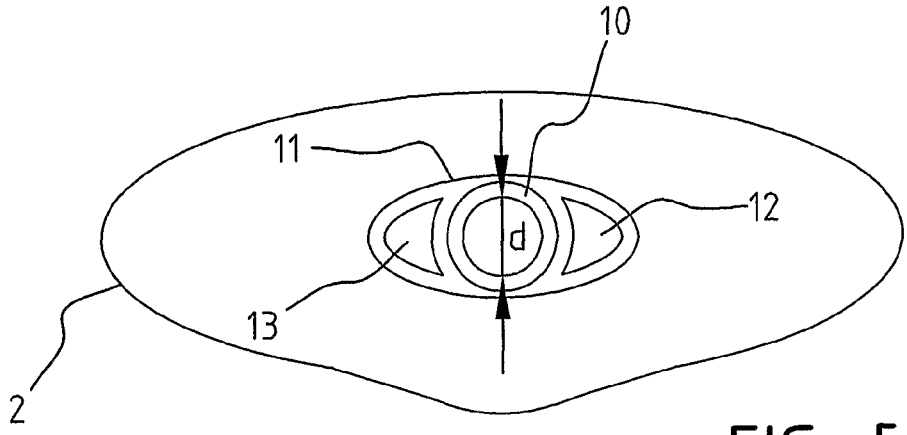
FIG. 5 shows a rear view of the preferred embodiment of the smoking unit.

Owing to the shown construction all tobacco smoke in combustion space 15 is discharged when the smoker lights a cigarette but does not inhale any smoke from filter F. The oxygen required for combustion is supplied via openings 12, 13 arranged adjacently of holding ring 10 (as shown in FIG. 5). When the smoker draws on his/her cigarette, fans 21, 22 also continue to draw in the tobacco smoke so that no tobacco smoke can be lost via said openings 12, 13. When a smoker wishes to exhale the inhaled tobacco smoke, he/she places the mouth around the peripheral edge 11 of mouthpiece 9 and exhales the inhaled smoke into combustion space 15 via opening 12, 13 (direction $P_3$). The tobacco smoke exhaled by the smoker into combustion space 15 is filtered via the two filters and discharged in the above described manner using the fans.

In the embodiment shown in FIG. 9 the holding ring 10 is also provided with a connecting cylinder 14 for a tube-like element (not shown) that can be arranged round filter F. This tube-like element is intended for smokers who do not wish to touch the filter F itself. In most cases the tube-like element will however be omitted.

When the cigarette is almost finished, an extinguishing ring 32, which is placed close to the outer end of the filter as shown in FIG. 3, provides for extinguishing of the cigarette. Extinguishing ring 32 is herein provided at a location in the housing such that the cigarette is extinguished just before the filter itself is reached. In order to give the user an indication that the cigarette is almost finished, a sensor 31 (FIG. 9) can optionally be arranged in the housing. This sensor is heat-sensitive and generates a signal when the temperature increases sharply at the position of the sensor. When the cigarette has been smoked so far that the burning part is located close to sensor 31, this latter will therefore generate a signal so that the smoker knows that the cigarette is almost completely finished. In a determined embodiment the sensor is connected to a control circuit (not shown) of the fans. When the sensor generates said signal, the fans are switched off, optionally after a predetermined period (e.g. one minute).

When the cigarette is extinguished, it can be pulled out of the housing by grasping the outer end of filter F and pulling the remainder of the cigarette out of the housing in the direction opposite to direction $P_1$. It is however also possible to press the cigarette further inward, for instance by pushing with a subsequent cigarette against the filter of the smoked cigarette. The smoked cigarette is then released from holding ring 10 and optional extinguishing ring 32 and then drops into combustion space 15. In some embodiments the combustion space is dimensioned such that roughly as many cigarettes can be received therein as can be filtered by the filter. When the filter has lost its effect, for instance after ten, twenty or more cigarettes have been smoked, the smoker separates the proximal housing part 2 and distal housing part 3 at the position of seam 4 so that filter space 16 can be accessed from outside. Combustion space 15 can be cleaned in simple manner by being shaken out. Filter 26 in filter space 16 can be replaced in simple manner by removing bag 27 and arranging a new bag.

The distance (a) over which the filter protrudes beyond the housing of the smoking unit can vary. The distance (a) (FIG. 4) is preferably in the order of magnitude of 1.2 cm, so that the smoker has enough space to place his/her lips round the filter on the one hand and a sufficient clamping of the cigarette can be ensured on the other.

Figure 10:
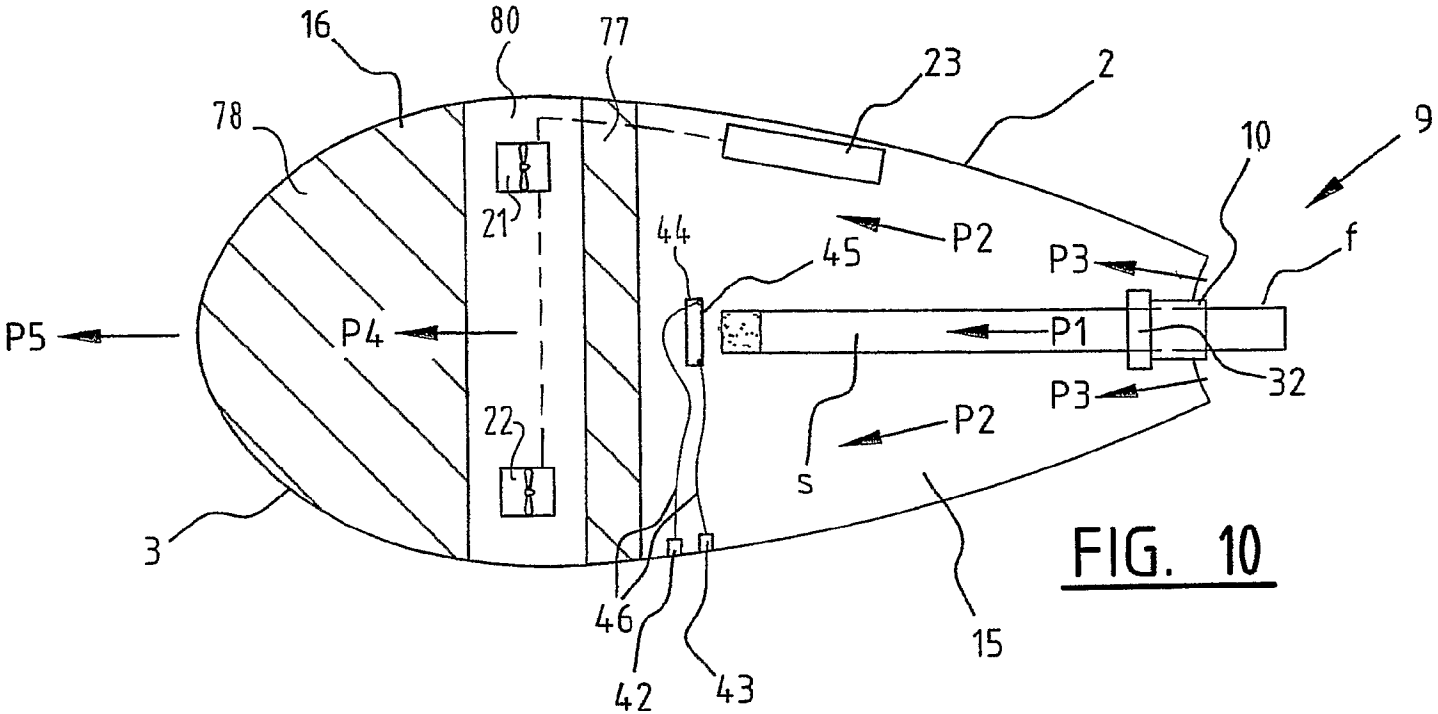
FIG. 10 is a partly cut-away top view of a further preferred embodiment.
Figure 11:
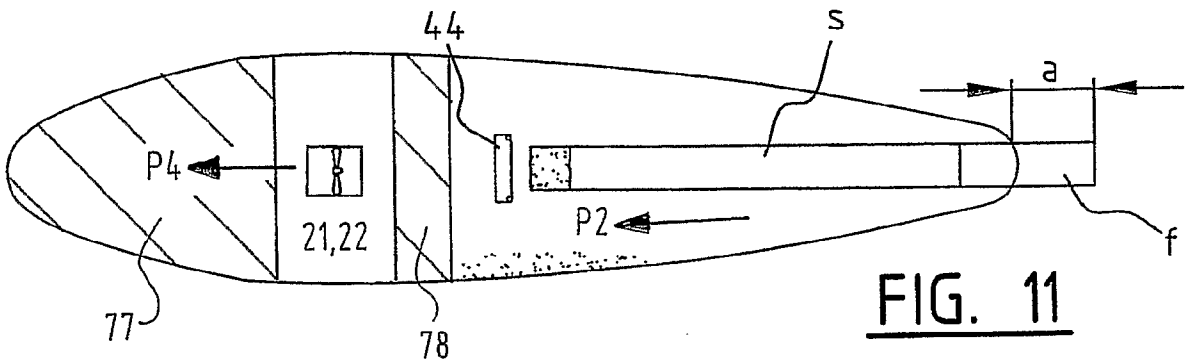
FIG. 11 is a partly cut-away side view of the embodiment of FIG. 10.

FIGS. 10 and 11 show a further preferred embodiment of the invention. This embodiment corresponds with the embodiment described above with reference to FIGS. 1-4, be it that in the above mentioned filter space 16 a first filter 77 is arranged for a pre-filtering of the supplied tobacco smoke as well as a second filter 78 (and optional further filters) for further treatment of the tobacco smoke. First filter 77 preferably consists of an optionally electrostatically charged HEPA filter, while second filter 78 preferably comprises a filter of active carbon. Two fans 21,22 are arranged in space 80 between first filter 77 and second filter 78.

The operation of a control button (not shown) provided on the housing ensures that the two fans 21 and 22 are switched on. Fans 20, 21 are coupled to an internal battery 23 and ensure that the tobacco smoke accumulating in the combustion space is drawn in via first filter 77. The tobacco smoke herein undergoes a first filtering so that the smoke gases in intermediate space 80 are relatively clean and thereby have less of an adverse effect on the operation of the fans.

Once the tobacco smoke has passed through HEPA filter 77 and intermediate space 80, it is discharged to the environment via second filter 78 and discharge openings 5 in housing part 3.

Figure 12:
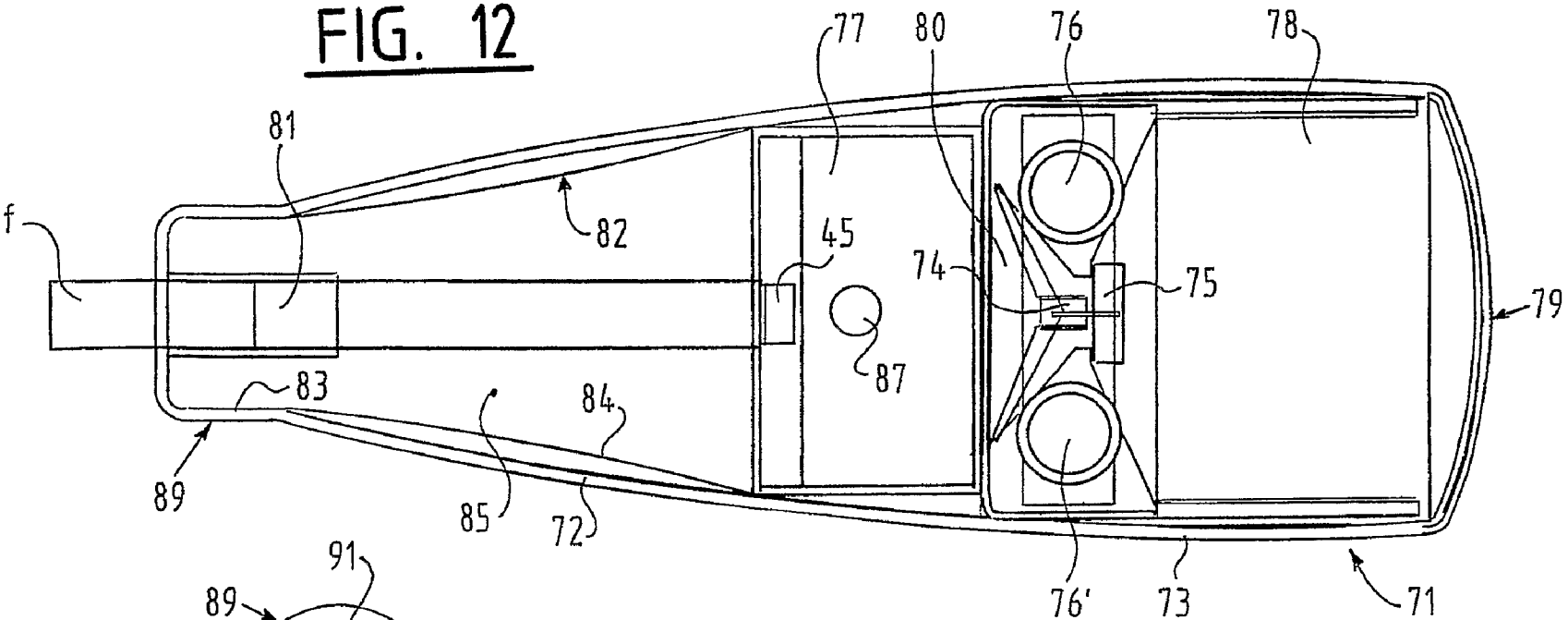
FIG. 12 is a partly cut-away view of yet another preferred embodiment.
Figure 13:
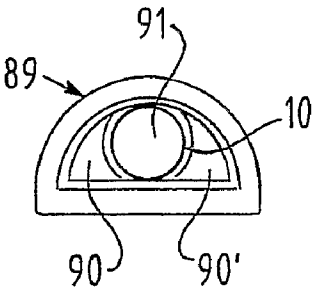
FIG. 13 shows a schematic cross-section at the position of the mouthpiece of the preferred embodiment of FIG. 12.

FIGS. 12 and 13 show a further preferred embodiment of the invention. The construction of this embodiment largely corresponds to that of the embodiment described with reference to FIGS. 10 and 11. A comprehensive description of this further embodiment is therefore dispensed with. The further embodiment comprises a housing 71 consisting of a proximal housing part 72 and a distal housing part 73. The proximal housing part 72 is adapted to collect and discharge the tobacco smoke from a burning cigarette and the tobacco smoke exhaled by a smoker in the above described manner, while distal part 73 is has the particular purpose of filtering and discharging the tobacco smoke to the environment.

A metal inner housing 84 is arranged in proximal part 72 of the housing in order to protect the interior of housing 72, which is preferably manufactured from plastic, from overheating.

Distal part 73 comprises an intermediate space 80, on either side of which filters are placed. A pre-filter 77 is provided upstream of intermediate space 80, while a second filter 78 is provided downstream of intermediate space 80. An electric motor 74 powered with batteries 76,76' is placed in intermediate space 80, which the tobacco smoke can only reach via first filter 77. Together with a blade 75 or the like, electric motor 74 forms a fan. The fan can be switched on or switched off via control button 87 and is disposed such that tobacco smoke from space 85 is drawn in via filter 77 and pressed through second filter 78, subsequently leaving housing 71 via discharge 79.

Owing to the shown construction all tobacco smoke in combustion space 15 is discharged when the smoker lights a cigarette but does not inhale any smoke from filter F. The oxygen required for combustion is supplied via openings 90,90' in mouthpiece 89. Openings 90,90' are arranged adjacently of holding ring 10 (as shown in FIG. 13). When the smoker draws on his/her cigarette, fan 74,75 also continues to draw in the tobacco smoke so that no tobacco smoke can be lost via said openings 90,90'. When a smoker wishes to exhale the inhaled tobacco smoke, he/she places the mouth around the peripheral edge of the mouthpiece and exhales the inhaled smoke into combustion space 15 (direction $P_3$) via opening 90,90'. The tobacco smoke exhaled into combustion space 15 by the smoker is filtered via the two filters and discharged in the above described manner using the fan.

Although it is sufficient in most cases to place one or more fans between the two filters, in a further embodiment (not shown) at least one fan is also positioned downstream of the second (or subsequent) filter 78 in order to further improve the throughflow of the tobacco smoke.

A smoking unit can further be provided with an indicator 92 which indicates that the cigarette is almost finished (and, if present, has almost reached the extinguishing ring 32), as for instance shown in FIGS. 1-4. Indicator 92 is constructed from a heat-conducting, preferably metal element 93 extending into combustion space 15. Temperature-sensitive dye, in particular of thermochromic material, is provided on the upper part of element 93. In an advantageous embodiment a blue dye is for example provided which becomes colourless at high temperatures, as well as a red dye. At low temperatures the upper part of indicator 92 therefore has a colour which is a combination of red and blue, i.e. dark purple, while at high temperatures the indicator becomes red. When indicator 92 becomes red, the user therefore knows that the smouldering outer end of the cigarette has reached the indicator. When the indicator is positioned at the end of the cigarette (in some embodiments the indicator is provided at another position, or several indicators are arranged), the smoker then knows that the cigarette is almost finished.

The present invention is not limited to the preferred embodiments thereof described herein. The rights sought are rather defined by the following claims, within the scope of which many modifications can be envisaged.

The invention claimed is:

1. A device for filtering tobacco smoke from a cigarette, comprising a portable housing provided with a combustion space in which the cigarette can burn, a filter unit for filtering the tobacco smoke of a burning cigarette, at least one discharge opening for discharging filtered tobacco smoke and one or more tobacco smoke displacing units for displacing the tobacco smoke via the filter unit to the discharge opening, wherein a mouthpiece is formed on the housing, the mouthpiece comprising a holding unit for holding the cigarette, wherein the holding unit comprises an opening along which the cigarette can be pushed partially into the housing from outside the housing, and the opening is formed to hold the cigarette clampingly in the partially inserted situation, wherein a filter space in which a filter unit is arranged is provided adjacently of the combustion space in the housing, and wherein the filter unit comprises:

a high-efficiency particulate air filter positioned between the combustion space and discharge opening; and an active carbon filter positioned between the high-efficiency particulate air filter and the discharge opening, wherein the filters are arranged in a filter bag, and wherein the filter bag is provided with attaching means which are adapted to attach the filter bag removably in the housing.

2. The device as claimed in claim 1, wherein a stop element is arranged in the combustion space for limiting the length along which the cigarette can be pushed into the housing.

3. The device as claimed in claim 2, wherein the igniting means are arranged close to the stop element.

4. The device as claimed in claim 3, wherein the stop element is formed by the igniting means.

5. The device as claimed in claim 1, wherein the stop element is positioned in the housing such that the cigarette extends wholly or partially outside the housing in the partially inserted situation.

6. The device as claimed in claim 5, wherein the distance between the stop element and the outer side of the mouthpiece is between 6 cm and 8 cm.

7. The device as claimed in claim 1, wherein the holding unit comprises a holding element with a substantially circular cross-section, the diameter of which corresponds substantially to the diameter of a cigarette.

8. The device as claimed in claim 1, wherein said mouthpiece is provided with one or more openings connected to the combustion space for feeding fresh air and discharging tobacco smoke exhaled by the smoker.

9. The device as claimed in claim 8, wherein the openings are positioned around the holding unit.

10. The device as claimed in claim 8, wherein the openings are positioned on either side of the holding unit.

11. The device as claimed in claim 1, wherein the high-efficiency particulate air filter is arranged in the form of a cone.

12. The device as claimed in claim 1, comprising:

electrical igniting means for lighting the cigarette, terminals which are coupled to the electrical igniting means and which are accessible from outside the housing for the purpose of powering the igniting means with an external electrical power source present outside the housing.

13. The device as claimed in claim 12, wherein the electrical terminals are provided in the housing wall and are adapted to be able to make contact with corresponding terminals of the electrical power source.

14. The device as claimed in claim 1, comprising a metal inner housing placed in the housing.

15. The device as claimed in claim 1, comprising a passive extinguishing element for extinguishing the cigarette when the cigarette has burned over a predetermined distance.

16. The device as claimed in claim 15, wherein the passive extinguishing element comprises an extinguishing ring positioned in use round a cigarette close to the filter.

17. The device as claimed in claim 1, comprising a visual indicator which is adapted to indicate that the cigarette has burned away to a predetermined extent.

18. The device as claimed in claim 1, comprising a heat-conducting element extending from the outside of the housing into the combustion space, provided with thermo-sensitive material for generating a color representative of the temperature in the combustion space.

19. A method for filtering tobacco smoke from a tobacco product with a device as claimed in claim 1, the method comprising:

drawing tobacco smoke from the combustion chamber with the tobacco smoke displacing unit and guiding the tobacco smoke through a high-efficiency particulate air filter of the first filter component for pre-filtering thereof;

pressing tobacco smoke through the second filter component with the tobacco smoke displacing unit for further filtering thereof; and discharging filtered tobacco smoke to the environment via the discharge opening.

20. The method as claimed in claim 19, comprising pressing tobacco smoke through an active carbon filter component.

21. The device as claimed in claim 1, wherein the high-efficiency particulate air filter is in a pleated form.

22. The device as claimed in claim 1, wherein the filter unit comprises an electrostatically charged high-efficiency particulate air filter.

* * * * *